US005927964A

United States Patent [19]

Fawcett

[11] Patent Number: 5,927,964

[45] Date of Patent: Jul. 27, 1999

[54] CANDLE WITH EMBEDDED METAL PARTICULATES

[75] Inventor: Sherwood Luther Fawcett, Columbus, Ohio

[73] Assignee: Transmet Corporation, Columbus, Ohio

[21] Appl. No.: 08/906,714

[22] Filed: Aug. 5, 1997

[51] Int. Cl.[6] ..... F23D 3/16

[52] U.S. Cl. ..... 431/288; 431/289; 431/293; 431/325; 431/126; D26/6

[58] Field of Search ..... 431/288, 289, 431/293, 291, 325, 126; 44/275; 208/20, 21; 362/161; D26/5, 6; 55/3; 264/247, 250

[56] References Cited

U.S. PATENT DOCUMENTS

| | | | |
|---|---|---|---|
| D. 178,200 | 7/1956 | McKenzie et al. | D26/6 |
| 2,310,019 | 2/1943 | Hamblet | 67/22.5 |
| 3,898,039 | 8/1975 | Lin | 21/108 |
| 3,983,677 | 10/1976 | Lundbom . | |
| 4,225,552 | 9/1980 | Chang | 264/247 |
| 4,568,270 | 2/1986 | Marcus et al. | 431/288 |
| 4,790,747 | 12/1988 | O'Brien | 431/325 |
| 4,917,597 | 4/1990 | Henze | 431/289 |
| 5,193,994 | 3/1993 | Schirneker | 431/293 |
| 5,395,233 | 3/1995 | Karp | 431/289 |
| 5,425,633 | 6/1995 | Cole | 431/291 |

FOREIGN PATENT DOCUMENTS 4016007 11/1991 Germany .

*Primary Examiner*—Ira S. Lazarus
*Assistant Examiner*—Donna L. Mann
*Attorney, Agent, or Firm*—Frost & Jacobs LLP

[57] ABSTRACT

A candle embedded with metal particulates is provided that includes a candle body, one or more wick wells, and one or more wicks. The candle body is formed of a moldable and combustible material, such as paraffin or wax. Additionally, the candle body includes a plurality of metal particulates disposed within the moldable and combustible material. Each wick is disposed within a wick well which is essentially a region of moldable and combustible material that is devoid of metal particulates so as to promote more uniform burning of the candle. Preferably, the metal particulates are aluminum wedge shaped flakes. The function of the metal particulates is threefold: 1) they maintain the shape and size of the candle throughout its burn life; 2) they conduct heat from the flame throughout the candle body to permit melting and flowing of liquid wax throughout the candle body to the wicks; and 3) they reflect the candle flame light from the top surface of the candle. Similar to a traditional candle, one or more wicks may be disposed substantially vertically within the candle body. Alternatively, one or more plane cloth wicks may be disposed substantially vertically in the candle body with the top edge extending above the surface of the candle body to form a continuous line of flame when lit. In an alternative embodiment, a metal particulate candle cap is provided for use on the top of a large diameter traditional candle in order to promote more efficient use of wax in the traditional candle while being burned.

15 Claims, 4 Drawing Sheets

CANDLE WITH EMBEDDED METAL PARTICULATES

TECHNICAL FIELD

The present invention relates generally to candles, and is specifically disclosed as a wick-type candle that is made from a moldable and combustible material having a number of metal particulates embedded therein.

BACKGROUND OF THE INVENTION

Candles of varying composition, sizes, and types are well known in the art. Throughout recorded history, candles have commonly been used as sources of illumination. The candle probably first evolved from wood, rushes, or cords dipped in fat or pitch. Candles competed with the lamp in Roman times and were more commonly used in Western Civilizations during the Middle Ages. Candles made from tallow, beeswax, and vegetable wax, such as bayberry in the American Colonies, were commonly used through the late $18^{th}$ century. By the mid-$19^{th}$ century, candles made from stearine and/or paraffin, were most commonly used. The plaited wick gradually replaced wicks of twisted strands by the mid-$19^{th}$ century.

In the past, candles were commonly made by repeated dipping in melted tallow, by pouring tallow or wax into molds, or by pouring beeswax over the wicks. Today, modern candles are machine-made by a molding process. Although traditional candles may be molded in a variety of shapes and sizes, they all burn in essentially the same way. Generally, a candle includes a cloth or fiber wick in the candle body that runs from the bottom to the top of the candle and extends a short distance above the top surface of the candle. This protruding portion of the wick carries the flame. While burning, radiant energy melts a small layer of the candle wax on the top surface of the candle. This melted wax is drawn up the wick by capillary action where it fuels the flame. As this combustion process continues, the flame moves down the candle as the wax melts. The excess wick burns up as the flame moves down until finally, if left unattended, essentially the entire candle would be consumed. Traditional candles tend to be relatively long or tall with a relatively small diameter. If the diameter of a traditional candle is too large, the flame is more susceptible to being extinguished in the resultant larger pool of melted wax, or the flame becomes buried in a deep well in the candle.

Because traditional candles are entirely consumed when burned, there is no uniformity or consistency of their size and shape throughout the burning process. In addition, candles, due to their limited flame size, do not generally produce a relatively large amount of illumination as compared with alternative light sources.

SUMMARY OF THE INVENTION

Accordingly, it is a primary object of the present invention to provide a candle that can be formed in various artistic shapes and that substantially retains its shape characteristics while burning.

It is another object of the present invention to provide a candle that produces relatively more illumination than traditional candles.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved candle is provided that includes a candle body, one or more wick wells, and one or more wicks. The candle body is formed of a moldable and combustible material, such as paraffin or wax. Additionally, and according to an important aspect of the present invention, the candle body further includes a plurality of metal particulates disposed within the moldable and combustible material. Each wick is disposed within a small wick well which is essentially a region of moldable and combustible material that is devoid of metal particulates. Preferably, the metal particulates are aluminum wedge shaped flakes. More preferably, each aluminum flake has a thickness of about 0.01 to about 0.02 inches and a length and width ranging from about 0.04 to about 0.15 inches. Each wick may be substantially vertically disposed within the candle body with a portion of each of the vertically disposed wicks extending from above the top surface of the candle body to the bottom of the candle, in much the same manner as a traditional candle. Additionally, one or more of the wicks may be formed of a substantially flat fiber cloth plane (rather than a fiber strand) which is vertically disposed in the candle with one edge extending slightly above the horizontal surface of the candle. Preferably the fiber cloth plane wick extends substantially to the bottom of the candle.

Still other objects of the present invention will become apparent to those skilled in this art from the following description and drawings wherein there is described and shown a preferred embodiment of this invention in the best mode contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawing:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
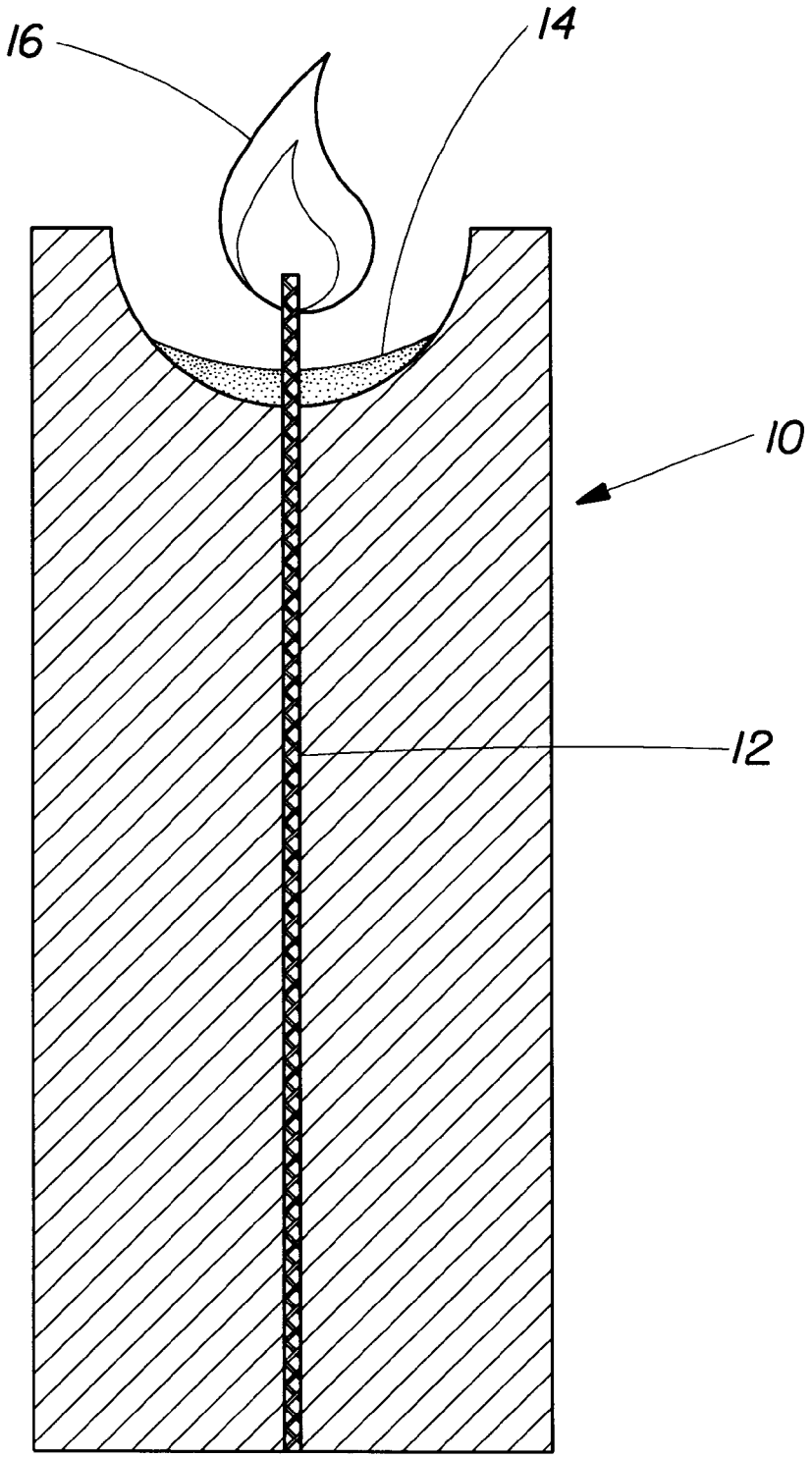
Fig. 1 (Prior Art)
FIG. 1 is a cross-sectional view of a traditional prior art candle.

Referring now to the drawings, FIG. 1 shows a traditional prior art candle being burned, generally designated by the numeral 10. The candle 10 includes a cloth or fiber wick 12, usually of a small cylindrical shape, disposed within the candle body that runs from the bottom to the top of the candle and extends a short distance above the top surface of the candle. The wick 12 is preferably approximately centrally disposed within the candle body. The protruding portion of the wick carries the flame 16 while being burned. While the candle is being burned, radiant energy from the flame 16 melts a small layer of the candle wax 14 on the top surface of the candle. This melted wax 14 is drawn up the wick 12 by capillary action where it fuels the flame 16. While the process continues, the flame moves down the candle as the wax melts.

As can be seen in FIG. 1, it is preferred that the traditional candle 10 be relatively tall with a relatively small diameter, because if the diameter of the traditional candle is too large, a larger pool of melted wax 14 is generated and the flame 16 is more susceptible to being extinguished in the resultant larger pool of melted wax 14, or being buried or hidden within the candle recess.

Figure 2:
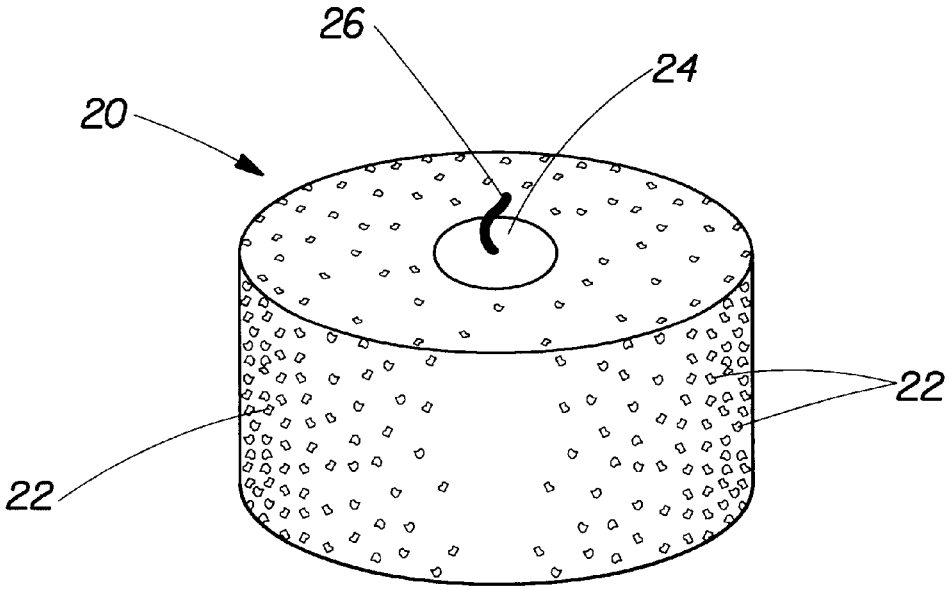
FIG. 2 is a perspective view of the preferred embodiment of the metal particulate candle of the present invention.

FIG. 2 illustrates the candle with embedded metal particulates 22 of the present invention, generally designated by the numeral 20. Although it is preferred that paraffin be used as the moldable and combustible material, it will be understood that essentially any suitable material having adequate moldability and combustibility characteristics may be used. The candle 20 may be molded by placing hot metal particulates into the mold and pouring liquid wax into the mold, by pouring a wax and metal particulate mixture into the mold, or by any other method normally used in modern candle production.

Additionally, and according to an important aspect of the present invention, the candle body 20 further includes a plurality of metal particulates 22 disposed within the moldable and combustible material. Preferably, the metal flakes occupy from about 10% to about 25% of the volume of the candle body. More preferably, the metal flakes occupy about 17% of the volume of the candle body 20. Preferably the metal flakes 22 are produced by a rapid solidification process which produces a fine grain structured body. More preferably, the particulates 22 are comprised of aluminum flakes. Preferably, the metal flakes exhibit very high geometric surface area to unit volume ratio of about 50 in $^2$/in $^3$ to about 300 in $^2$/in $^3$. As it will be understood candle 20 of the present invention may be molded to have a relatively large width as compared with its depth. Cloth wick material may be fabricated of various sizes depending on the requirements of the particular candle application. The metal particulates 22 are of a size and shape that are small enough to fill the various small regions of the mold and at least a portion of the flakes are preferably in touch contact with each other. The flakes are further preferably large enough so that when they are hot they do not become "wick-like" and cause flaming on the candle surface.

Figure 3:
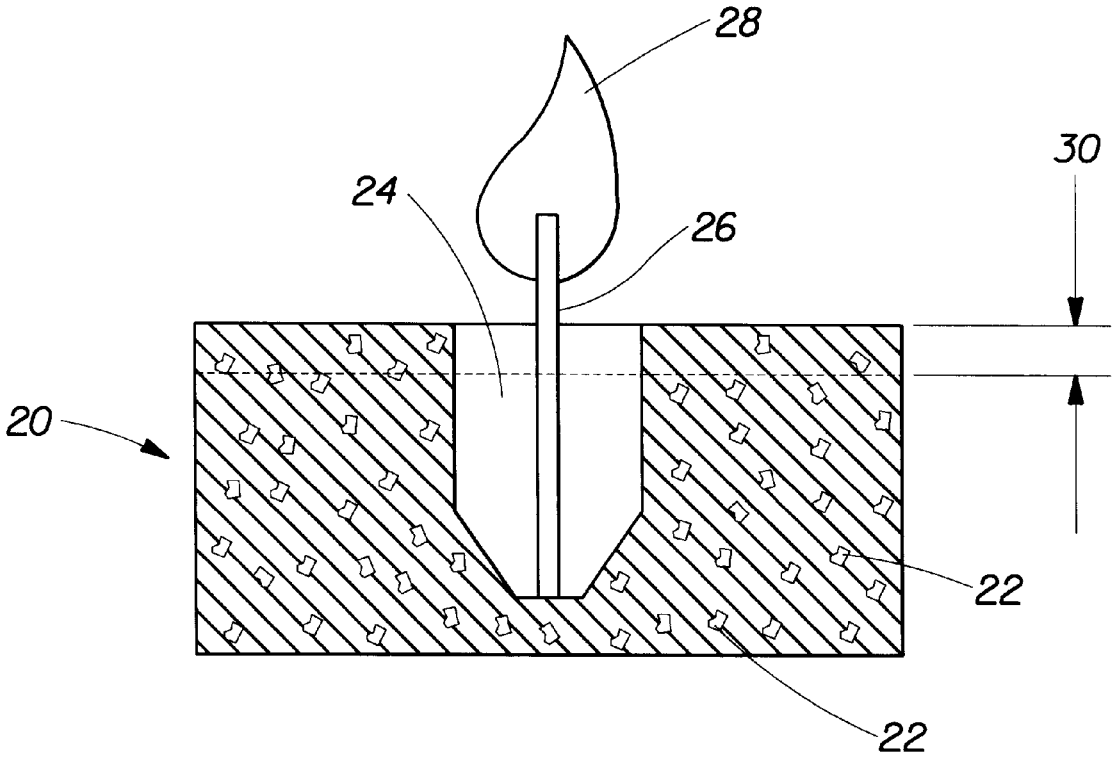
FIG. 3 is a cross-sectional view of the preferred embodiment of a burning metal particulate candle of the present invention.

The candle 20 further includes one or more wicks 26 disposed within a wick well 24. As can be seen in FIGS. 2 and 3, the wick well 24 comprises a small region of moldable and combustible material that is substantially devoid of metal particulates 22. This particulate free zone 24 is more conducive to uniform burning in that it provides a sufficient region for liquid wax to unimpededly pool and be drawn into the wick. Preferably, the wick well radially extends about 0.1 in. from the wick. The wick well is necessary in relighting the candle because if metal particulates are disposed too close to the wick, they would dissipate the heat too rapidly and sufficient liquid wax would not form and the candle 20 would not produce a constant flame 28 on relighting. Obviously, the preferred dimensions of each wick well 24 may be varied depending on the depth and width of the candle body 20.

Similar to traditional candles, the metal particulate candle of the present invention includes one or more wicks 26. Preferably, one or more wicks 26 are disposed within the wick well 24 in a substantially vertical configuration similar to the orientation of the wicks in traditional prior art candles. It is preferred that the wicks 26 be made of high temperature fibers such as fiberglass or quartz since they should maintain their original size and shape throughout the life of the candle. Advantageously, this will permit multiple burning periods without substantially diminishing the length of the wick. Alternatively, the wicks 26, may be made of woven cloth or plaited cloth.

As best shown in FIG. 3, and similar to a traditional candle, when candle 20 of the present invention is lit, a layer of liquid wax 30 is formed which flows into wick well 24 to fuel the flame 28. Advantageously, flakes 22, because they are metal, have good heat conduction characteristics, which serve to transfer the heat across the width of the candle body 20, thus resulting in more uniform melting across the width of the candle 20. Accordingly, candle 20 of the present invention may have a relatively wide width as compared with its depth and still achieve efficient and substantially uniform melting across the width of the candle 20, unlike a traditional candle of a similar width. Additionally, the metal particulates 22 maintain the original shape of the candle throughout the burn life of the candle and reflect the wick light from the flame thus augmenting the total light from the candle.

Although the metal particulate candle of the present invention is depicted in the figures as being of a relatively flat cylindrical shape, it will be understood that candle 20 may be cast into various shapes. For example, candle 20 may be cast into the form of letters or numbers, into the shapes of animals, hearts, or essentially any other figure to commemorate social events or for other decorative purposes.

Figure 4:
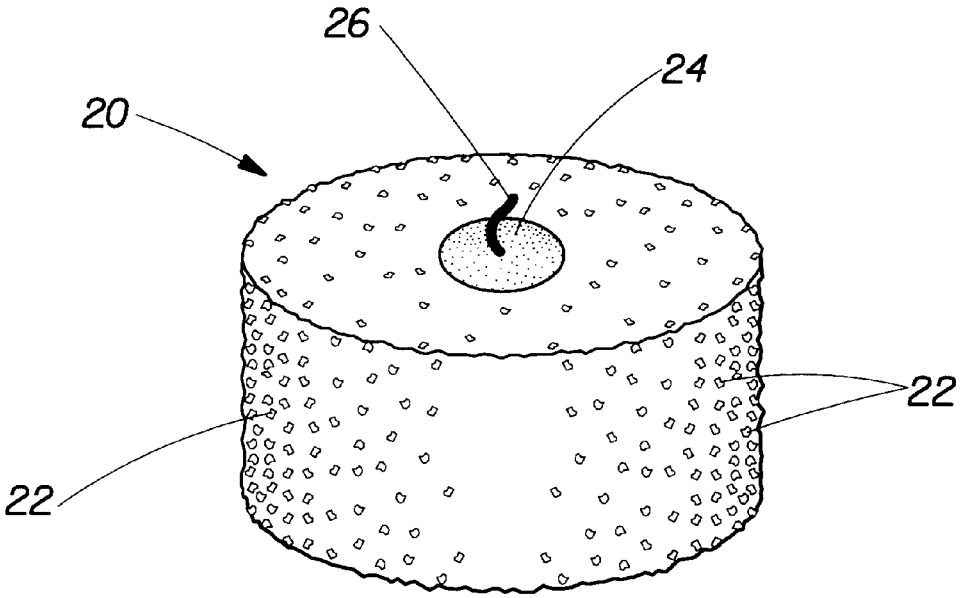
FIG. 4 is a perspective view of the candle of the present invention after it has been burned.

According to an important aspect of the invention, and unlike traditional candles of the prior art, the candle 20 of the present invention substantially retains its shape characteristics while burning and after it has been burned. For example, after burning, and if left undisturbed, the candle body will cool and harden into a rigid, porous body of metal particulates 22 held together by remnants of cold wax as shown in FIG. 4. Advantageously, this is an easily recyclable aluminum body. Alternatively, the "used" candle body may be used as a paperweight or for other decorative purposes and may serve as a souvenir from a social event or other occasion.

Figure 5:
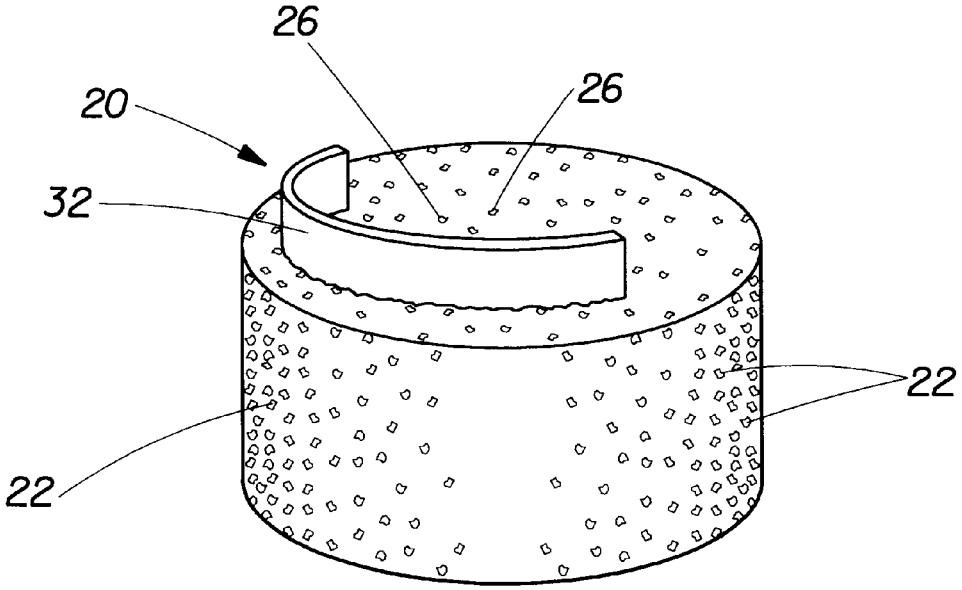
FIG. 5 is a perspective view of an alternative embodiment of the metal particulate candle of the present invention showing a substantially flat cloth plane wick disposed vertically in the candle body extending slightly above the surface of the candle.

As shown in FIG. 5, and in an alternative embodiment of the candle 20 of the present invention, candle 20 may be provided with one or more substantially flat cloth plane wicks 32 instead of or in addition to standard wicks 26. The fiber cloth plane wick is preferably composed of fiberglass or quartz fiber cloth. These cloth plane wicks are preferably vertically disposed in the candle, similar to standard wicks, with one edge extending slightly above the horizontal surface of the candle, and the cloth wick extending to the bottom of the candle body. The result is a flame line rather than a flame point, as results with the use of a standard wick.

Advantageously, these "flame line wicks" 32 allow for the flame illumination of novel markings, figures, letters and other decorations on the candle's top surface. For example, a flat round pie-tin sized candle may be provided with standard type wicks for eyes, a V-shaped flame line nose and a crescent-shaped flame line mouth. These types of wicks and the resultant novel candles are feasible with the embedded metal particulate candles since the candle body does not change its size and shape throughout the burning life of the candle.

Figure 6:
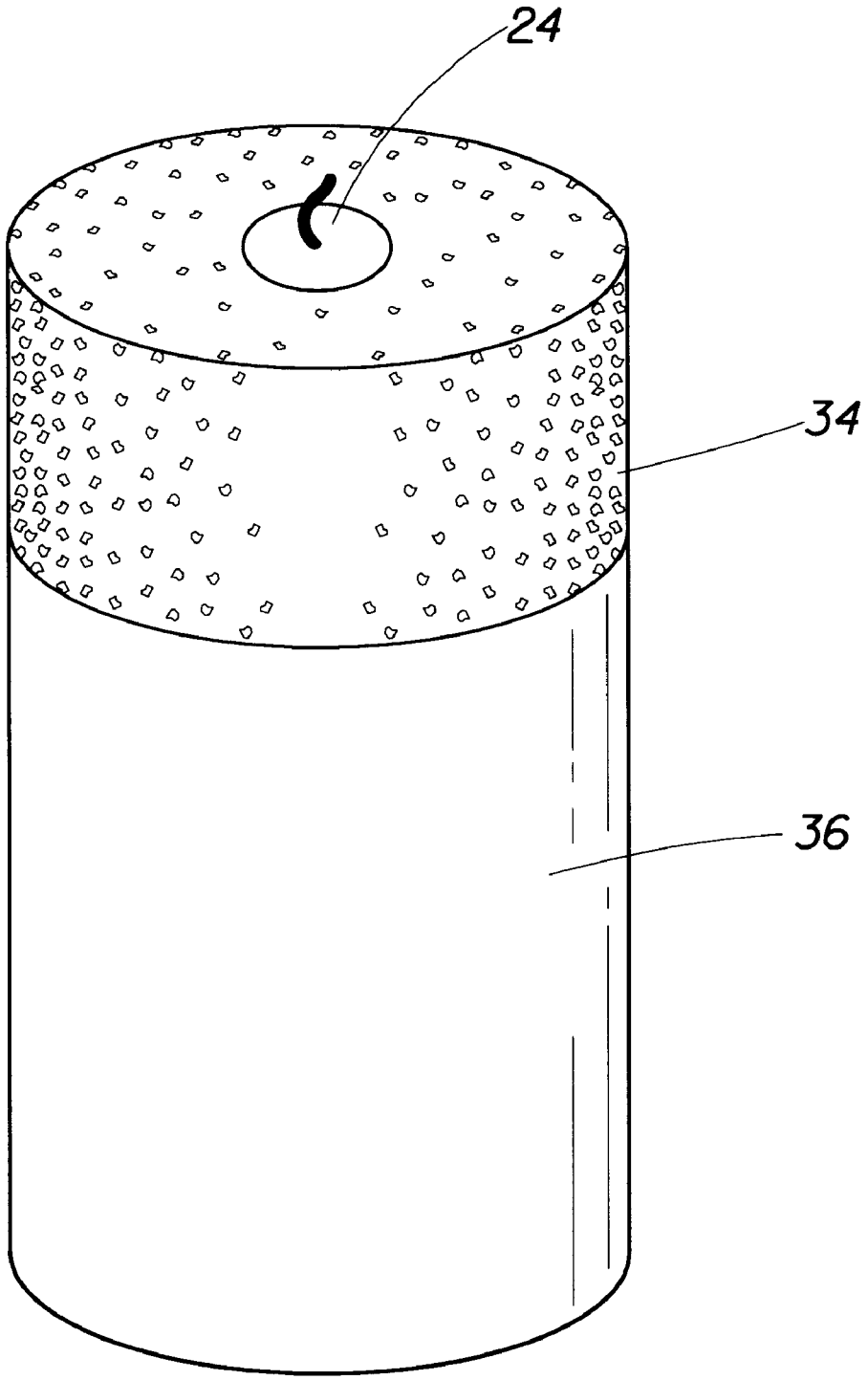
FIG. 6 is a perspective view of an alternative embodiment of the metal particulate candle of the present invention showing a metal particulate candle cap disposed on the body of a traditional candle.

In another alternate embodiment of the present invention, as shown in FIG. 6, a metal particulate candle 20 of the present invention may be cast onto the top of a larger diameter traditional candle to form a particulate candle "cap" 34. In this embodiment, the metal particulate candle "cap" 34 would continuously melt the candle base and the whole cap would move down relatively uniformly as the wax in the candle body is consumed. Advantageously, this metal particulate candle cap 34 would extend the life of a large candle compared with a traditional candle 36 lacking the cap 34 as traditional candles tend to leave a large external rim or wall of unburned and unconsumed wax. In contrast, the metal particulate cap 34 would conduct the heat across the width of the large candle 36 advantageously melting the entire width of the candle body 36 and drawing the resultant melted wax into the wick well 24 for combustion.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed:

1. A candle comprising:

(a) a candle body, said candle body having a top surface, said candle body further being formed of a moldable and combustible material;

(b) a plurality of thermoconductive metal particulates disposed within said candle body, each said metal particulate having a thickness of about 0.01 to about 0.02 inches and a length and width ranging from about 0.04 to about 0.15 inches;

(c) one or more wick wells, each said wick well being disposed within said candle body, each said wick well being formed of a moldable and combustible material; and (d) one or more wicks, each said wick being disposed within one of said wick wells.

2. The candle of claim 1, wherein said moldable and combustible material is comprised of paraffin, a wax, a mixture thereof, or any of the preceding materials in combination with fragrance oil.

3. The candle of claim 2, wherein each said wick is substantially vertically disposed within said candle body and wherein at least a portion of each said wick extends above said top surface of said candle body.

4. The candle of claim 2, wherein at least one of said wicks is comprised of a substantially flat cloth plane, said cloth plane being substantially vertically disposed within said candle body and wherein at least a portion of said cloth plane extends above said top surface of said candle body.

5. The candle of claim 4 wherein said cloth plane extends substantially through said candle body towards a bottom portion of said candle body.

6. The candle of claim 2, wherein said metal particulates comprise from about 10% to about 25% of the volume of said candle body.

7. The candle of claim 1, wherein said wick is comprised of fiberglass or quartz material.

8. The candle of claim 1 wherein said metal particulates comprise aluminum flakes.

9. A candle cap for use atop a candle made of a moldable and combustible material, said candle cap comprising:

(a) a candle cap body, said candle cap body being formed of a moldable and combustible material;

(b) a plurality of metal particulates disposed within said candle cap body;

(c) one or more wick wells, each said wick well being disposed within said candle cap body, each said wick well being formed of a moldable and combustible material; and (d) one or more wicks, each said wick being disposed within one of said wick wells;

whereby the candle cap, when lit, conducts heat across the width of the candle thus melting the candle and moving down relatively uniformly as the candle is consumed.

10. The candle cap of claim 9, wherein said metal have a thickness of about 0.01 to about 0.02 inches and a length and width ranging from about 0.04 to about 0.15 inches.

11. The candle cap of claim 10, wherein said moldable and combustible material is comprised of paraffin, a wax, a mixture thereof, or any of the preceding materials in combination with fragrance oil.

12. The candle cap of claim 11, wherein each said wick is substantially vertically disposed within said candle cap and wherein at least a portion of each said wick extends above said top surface of said candle cap.

13. The candle cap of claim 12, wherein said metal particulates comprise from about 10% to about 25% of the volume of said candle cap.

14. The candle cap of claim 9, wherein each said wick is comprised of fiberglass or quartz material.

15. The candle cap of claim 10 wherein said metal particulates comprise aluminum flakes.

* * * * *